US007182226B2

(12) United States Patent
Mbonyumuhire

(10) Patent No.: US 7,182,226 B2
(45) Date of Patent: Feb. 27, 2007

(54) DOSING DEVICE COMPRISING A MEDIUM RESERVOIR AND CORRESPONDING PUMP DEVICE

(75) Inventor: Pierre Mbonyumuhire, Radolfzell (DE)

(73) Assignee: Ing. Erich Pfeiffer GmbH, Radolfzell (DE)

( * ) Notice: Subject to any disclaimer, the term of this patent is extended or adjusted under 35 U.S.C. 154(b) by 161 days.

(21) Appl. No.: 10/490,573

(22) PCT Filed: Sep. 17, 2002

(86) PCT No.: PCT/EP02/10421

§ 371 (c)(1),
(2), (4) Date: Oct. 4, 2004

(87) PCT Pub. No.: WO03/026805

PCT Pub. Date: Apr. 3, 2003

(65) Prior Publication Data

US 2005/0098583 A1 May 12, 2005

(30) Foreign Application Priority Data

Sep. 21, 2001 (DE) ..... 101 48 899
Apr. 20, 2002 (EP) ..... 02008878

(51) Int. Cl.
*B05B 9/04* (2006.01)

(52) U.S. Cl. ..... 222/321.7; 222/321.2; 222/340; 239/333

(58) Field of Classification Search ..... 222/321.2, 222/321.7, 321.8, 321.9, 340; 239/333

See application file for complete search history.

(56) References Cited

U.S. PATENT DOCUMENTS

| | | | | |
|---|---|---|---|---|
| 4,174,055 | A | 11/1979 | Capra et al. | 222/319 |
| 4,183,449 | A * | 1/1980 | Blake | 222/321.2 |
| 4,369,900 | A | 1/1983 | Kishi et al. | 222/321.2 |
| 4,371,097 | A | 2/1983 | O'Neill | 222/321.7 |
| 4,503,997 | A * | 3/1985 | Corsette | 222/321.9 |
| 4,830,284 | A | 5/1989 | Maerte | 239/333 |
| 5,351,863 | A | 10/1994 | Dupont et al. | 222/321.8 |
| 5,401,148 | A * | 3/1995 | Foster et al. | 417/547 |
| 5,505,343 | A * | 4/1996 | Knickerbocker | 222/321.1 |
| 5,769,274 | A | 6/1998 | Behar | 222/95 |
| 6,006,949 | A * | 12/1999 | Foster et al. | 222/153.13 |
| 6,050,457 | A | 4/2000 | Arnold et al. | 222/321.9 |
| 6,250,509 | B1 | 6/2001 | Fuchs | 222/321.6 |
| 6,276,568 | B1 | 8/2001 | Brotspies et al. | 222/321.6 |

FOREIGN PATENT DOCUMENTS

| | | |
|---|---|---|
| DE | 297 17 240 | 11/1997 |
| EP | 0 000 313 A | 1/1979 |
| WO | WO 00/49988 | 8/2000 |

* cited by examiner

*Primary Examiner*—Patrick F. Brinson
(74) *Attorney, Agent, or Firm*—Flynn, Thiel, Boutell & Tanis, P.C.

(57) ABSTRACT

The invention relates to a dosing device that comprises a medium reservoir (S) and a pump device for dosing and dispensing a medium stored in said medium reservoir. The pump device is associated with a pump chamber, and with at least one inlet and one outlet valve. According to the invention, the inlet valve is configured as a sliding valve (10, 12) which, in its closed position, can be displaced by a dosing stroke that defines a dosing volume for the pump chamber (17). The invention further relates to the use of said dosing device for dispensing pharmaceutical active substances, especially for nasal administration.

12 Claims, 5 Drawing Sheets

DOSING DEVICE COMPRISING A MEDIUM RESERVOIR AND CORRESPONDING PUMP DEVICE

FIELD OF THE INVENTION

The invention relates to a dosing device with a medium reservoir, as well as with a pumping device for dosing and dispensing a medium stored in the medium reservoir, a pump chamber, at least one inlet valve and at least one outlet valve being associated with the pumping device, as well as a pumping device for such a dosing device.

BACKGROUND OF THE INVENTION

DE 33 15 334 A1 discloses a dosing device provided with a pumping device and which is equipped with a medium reservoir for storing in particular liquid, pasty or creamy media. In addition to an inlet valve, an outlet valve and an additional outlet valve in the vicinity of an outlet opening are associated with the pump chamber, the additional outlet valve being opened by means of a stepped plunger or piston through a liquid pressure which has built up within the pumping device. For this purpose a valve body is provided and is urged into the closing direction by a spring web arrangement.

The problem of the invention is to provide a dosing device of the aforementioned type permitting a precise dosing and dispensing of a medium.

This problem is solved in that the inlet valve is constructed as a slide valve, which is movable by means of a dosing stroke in its closed position and this defines a dosing volume for the pump chamber. As a result of the dosing stroke of the slide valve an extremely precise dosing is made possible. As a function of the dosing stroke length different dosing volumes can be obtained.

According to a development of the invention, on both sides the slide valve can be transferred into an open position over and beyond the dosing stroke, which makes it possible to bring about a particularly precise dosing. In addition, through the bilateral transferability of the slide valve into its open position a priming of the dosing device is made possible. Thus, when the dosing device is first put into operation the air volume in the pump chamber can be displaced, particularly into the medium reservoir. In the direction of the medium reservoir, i.e. away from the pump chamber, the slide valve passes into the open over and beyond the dosing stroke, i.e. into its open position facing the medium reservoir.

According to a further development of the invention the dosing stroke is formed by a housing-side dosing channel matched to the slide valve contour and which is bounded both towards the pump chamber and also the medium reservoir by in each case a cross-sectional widening. Preferably the dosing channel is formed on a detachably positioned component. Thus, as a function of the necessary dosing volume it is possible to use a suitable component with a dosing channel of differing length. The dosing channel length defines the dosing stroke and therefore also the dosing volume of the dosing device. By simply replacing the component the dosing device is made suitable for different uses. As soon as the slide valve has reached the particular cross-sectional widening, it opens, so that in both stroke directions the slide valve can be transferred into an open position.

According to a further development of the invention the pump chamber has at least one housing-side reception space, with which is associated a displacement body movable together with the slide valve and whose shape is matched to the cross-section of the reception space in such a way that the displacement body, on introduction into the reception space, almost completely fills the latter. This makes it possible to keep the clearance volume of the pump chamber of the dosing device extremely small, which further improves the dosing precision.

In a further development of the invention a pump spring arrangement used as a return stroke drive is positioned outside the flow paths of the medium to be dispensed and in particular outside the pump chamber. Therefore the pump spring arrangement cannot be attacked by the ingredients of the particular medium to be dispensed. Through the pump spring arrangement positioned outside the flow paths of the medium it is also ensured that there is no contamination of the medium by the pump spring arrangement and in particular by the corrosion thereof.

According to a further development of the invention a return stroke spring arrangement associated with an outlet valve body is positioned separately from the flow path of the medium to be dispensed. In particular, the return stroke spring arrangement is housed in a medium-tight area separate from the pump chamber. Thus, the return stroke spring arrangement cannot be attacked by ingredients of the medium.

Improved use possibilities are created for the pumping device in that it is designed as a subassembly manufactured separately from the dosing device and detachably connectable to the latter. This makes it possible to construct the pumping device in a unitary manner and introduce it into different dosing devices.

BRIEF DESCRIPTION OF THE DRAWINGS

Further advantages and features of the invention can be gathered from the claims and the following description of preferred embodiments of the invention with reference to the attached drawings, wherein show:

DETAILED DESCRIPTION

Figure 1:
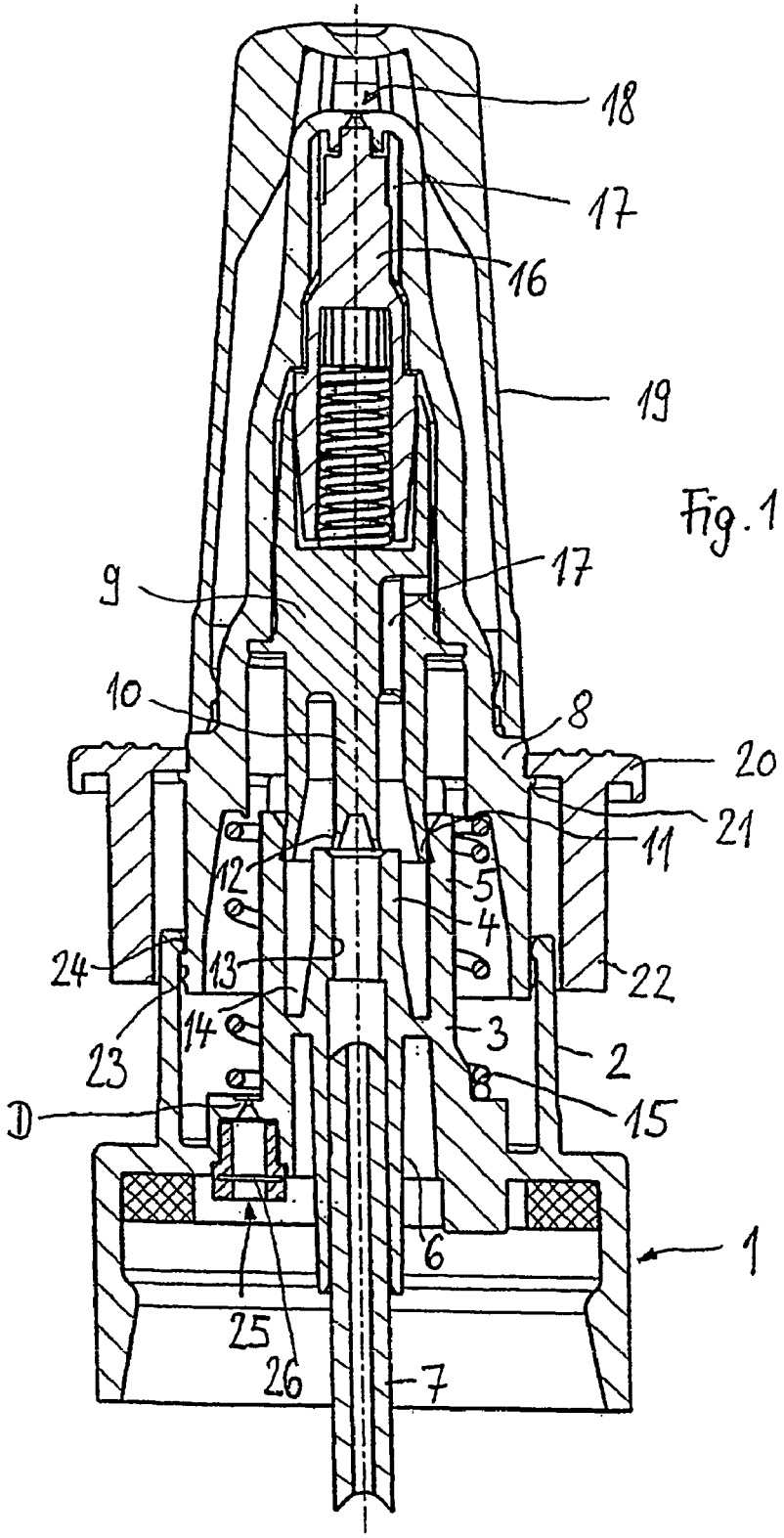
FIG. 1 In a longitudinal section an embodiment of a dosing device with a pumping device and a pressure compensating device.

A dosing device according to FIG. 1 has a cover 1, which can be locked onto a medium reservoir, preferably the form of a bottle-like or can-like container. For this purpose the cover 1 is cup-shaped and has on its inner circumference a not further designated annular shoulder, which can be locked onto a corresponding annular flange in a neck area of the medium reservoir. In an upper area of the cover 1 is provided a not designated, circumferential, elastic seal, which is compressed on locking the cover 1 on the medium reservoir neck and consequently ensures a tight sealing of the medium reservoir. A cup-like reception part 2 is integrally shaped onto the cover 1 and projects upwards counter to the not shown medium reservoir coaxial to a centre line axis of the cover 1. The reception part 2 forms an outer, jacket-like casing part for a subsequently further described pumping device, which is part of the dosing device of FIG. 1. A fixed pump casing part 3 is also provided integrally and projecting from the cover 1 and in fact coaxially within the reception part 2 and said part 3 is provided with a discharge channel 6 coaxially to the centre line axis of the cover 1 and said channel is open both downwards to the medium reservoir and upwards towards a dosing opening 18. In a lower portion of the discharge channel 6 is inserted a fundamentally known, preferably flexible suction connection 7. An upper portion of the discharge channel 6 is in the form of a dosing segment 13, in that said upper portion, starting from a stepped taper of the discharge channel 6, constitutes a cylindrical dosing channel with a reduced diameter compared with the lower portion of the discharge channel 6. The dosing segment 13 in the form of a dosing channel is surrounded by an inner cylinder jacket 4.

In radially spaced manner with respect to the inner cylinder jacket 4, the inner pump casing part 3 forms an outer cylinder jacket 5 which, like the inner cylinder jacket 4, is integrally shaped onto the cover 1. The outer cylinder jacket 5 is oriented coaxially to the inner cylinder jacket. Between the inner cylinder jacket 4 and the outer cylinder jacket 5 is left an annular displacement area 14, to which further reference will be made hereinafter and which forms part of a pump chamber.

Relative to the reception part 2 fixable in secured manner to the medium reservoir, including the inner pump casing part 3, is mounted in lift-movable or stroke-movable manner a pump unit. The stroke-movable pump unit has an outer pump casing part 8, which is firmly connected to an inner pump plunger or piston unit 9 to 11. The pump plunger unit 9 to 11 is manufactured separately as an integral component and is locked in the interior of the outer pump casing part 8. The pump plunger unit has a plunger body 9, which forms in an upper area a cylinder space for a coaxially positioned, stroke-movable outlet valve 16. The outlet valve 16 is so pressure-loaded in the closing direction by a compression spring arrangement, here in the form of a not further designated helical compression spring, that the plunger-like outlet valve 16 closes the outlet opening 18. The compression spring arrangement is placed in the interior of the plunger-like outlet valve 16 and is supported on a base of the cylinder space of the plunger body 9. The cylinder space of the plunger body 9 is provided in its upper marginal area with a circumferential sealing lip, which engages in circumferentially tight manner on the outer jacket of the plunger-like outlet valve 16. As a result the cylinder space and consequently also the reception space for the compression spring arrangement is sealed against the penetration of a medium, particularly a liquid. The outlet valve 16 is at the same time constructed as a filler, in that it almost completely fills the outer pump casing part 8. The plunger body 9 is also designed as a filling member, in that its outer contour is largely adapted to the inner contour of the outer pump casing part 8.

In the plunger body 9 is formed a first portion of an outlet chamber 17 belonging to the pump chamber and which is open to the displacement area 14 and dosing segment 13. Said first portion is radially outwardly open in its upper area and passes into an annular chamber portion of the outlet chamber 17, which is formed between the outer jacket of the plunger body 9, the outer contour of the outlet valve 16 and the inner contour of the outer pump casing part 8. As a result of the locking connection of the plunger body 9 in an annular locking flange area with the outer pump casing part 8, the annular chamber portion is axially downwardly closed. In the direction of the outlet opening 18, the outlet valve 16 closes the annular chamber portion of the outlet chamber 17.

In a lower area the plunger body 9 forms a coaxially inner valve plunger 10, which together with the inner cylinder jacket 4 in the vicinity of the dosing segment 13 forms an inlet valve, in the form of a slide valve, for the pumping device. For this purpose the valve plunger 10, which is integrally shaped onto the plunger body 9, is provided in a lower area with an annular dosing lip 12, forming a sliding piston which engages tightly on an inner wall of the dosing channel forming the dosing segment 13 on introducing the valve plunger 10 into said dosing segment 13. The diameter of the sliding piston or dosing lip 12 is larger than the diameter of the valve plunger 10. The length of the valve plunger 10 and the stroke of the plunger body 9 and consequently the entire, stroke-movable pump unit are dimensioned in such a way that the dosing lip 12 in an upper opening position shown in FIG. 1 is positioned a short distance above the dosing segment 13. In a lower, completely downwardly pressed end position of the stroke-movable pump unit, the dosing lip 12 is introduced into the stepped widening of the discharge channel 6, i.e. it has moved downwards over and beyond the dosing segment 13. As the external diameter of the dosing lip 12 is smaller than the diameter of the discharge channel 6 in the stepped widened area and the diameter of the valve plunger 10 is smaller than the internal diameter of the dosing segment 13, in said lower end position of the pump unit there can be a medium exchange between the outlet chamber 17 and the medium reservoir, via the suction connection 7.

Coaxially and in radially spaced manner the valve plunger 10 is surrounded by a bell-like displacement plunger 11, which by means of a lower sealing edge is engaged in circumferentially tight manner on an inner wall of the annular displacement area 14. The cross-section of the bell-shaped displacement plunger 11 is adapted to the cross-section of the displacement area 14 in such a way that in the downwardly moved end position of the plunger body there is virtually no clearance volume in the displacement area, because in this position the displacement plunger 11 is completely introduced into the displacement area 14. The annular space between the outer wall of the valve plunger 10 and the inner wall of the displacement plunger 11 has its volume matched to the body volume of the inner cylinder jacket 4, so that the remaining clearance volume is further reduced in the case of a downwardly moved pump unit. In the vicinity of its outer jacket, the plunger-like outlet valve 16 is provided with several annular steps, which form pressure application faces for opening the outlet valve 16. The protective cap 19 has a conically downwardly widening bell shape, which is inverted over an upper shaped section of the outer pump casing part 8 and comes to rest axially on an annular shoulder ledge of the pump casing part 8. The protective cap is manually detachably locked onto the shaped section of the pump casing part 8. The external diameter of the protective cap 19 is smaller than the maximum external diameter of the pump casing part 8. The upper shaped section of the pump casing part 8 is designed as a nose olive, in order to permit application to the nose of the medium contained in the medium reservoir. Preferably the medium stored in the medium reservoir contains at least one pharmaceutical substance.

On an outer jacket area of the outer pump casing part 8 is locked an operating handle 20, which is provided on its top on at least two opposite sides with in each case one finger rest. In FIG. 1 the finger rests are provided with profiles. For axially securing the operating handle 20, a circumferential locking web 21 is provided on the outer circumference of the pump casing part 8 and above which is associated at least one locking groove in which are axially engaged the corresponding inner marginal portions of the operating handle 20. The operating handle 20 is preferably locked on the pump casing part 8 by means of a non-detachable locking connection, i.e. following the axial locking of the operating handle 20 it is no longer possible to remove it without destruction from the pump casing part 8.

Below the locking web 21 the pump casing part 8 has a cylindrical guide jacket, which is provided in its lower marginal area with several stop cams 23 distributed at the same height over the outer circumference of the guide jacket and which cooperate with a radially inwardly projecting, circumferential locking collar 24 of the jacket-like or cup-like reception part 2. The locking cams 23 and locking collar 24 form locking profiles, which ensure the axial securing of the stroke-moveable pump casing part 8 on the fixed reception part 2. The locking profiles 23, 24 axially retain the pump casing part 8 counter to the compressive force of a pump spring arrangement 15, which serves as a pump drive for the resetting of the stroke-movable pump unit into the starting position of FIG. 1. A manual pressing down of the pump unit consequently takes place counter to the compressive force of the pump spring arrangement 15. As can be gathered from FIG. 1, the pump spring arrangement 15 is positioned outside the outer cylinder jacket 5 of the inner, fixed pump casing part 8, so that the pump spring arrangement 15 is located outside the pump area through which the medium flows. Thus, it is not possible for the pump spring arrangement 15 to be in contact with the medium, e.g. a liquid containing at least one pharmaceutical substance.

The operating handle 20 has an annular securing extension 22, which as a cylinder jacket projects downwards and in the upper end position of the pump unit shown in FIG. 1 projects axially over the reception part 2 to the extent that it overlaps the area of the locking profiles 23, 24. The distance from the outside of the reception part to the inner wall of the protective extension 22 is preferably smaller than the radial extension of the locking profiles 23, 24, so that the rigid, annular protective extension 22 provides a protection against a detachment of the locking profiles 23, 24 and therefore serves as a removal preventer for the pump casing part 8.

As the cover 1 in conjunction with the previously described pumping device tightly seals a container serving as a medium reservoir, in the case of corresponding pumping processes there must be a pressure compensation in order not to impair the function of the pumping device. In the embodiment shown a pressure compensating device 25, 26, D is provided for this purpose and is integrated into the cover 1. The pressure compensating device has a nozzle hole D tapering in a pronounced manner to the outside and serving as a pressure compensating opening, whose narrowest diameter preferably does not exceed 0.2 mm to 0.3 mm. This ensures a gas exchange, whereas a liquid loss is minimized due to the extremely small nozzle hole D. This leads to a reduced evaporation, which is particularly advantageous for the filter arrangement 25 additionally provided in FIG. 1. The filter arrangement 25 has a not further designated reception housing for a membrane-like filter 26. The reception housing is inserted in a corresponding receptacle of the cover 1 and is preferably bonded into the same or is fixed thereto in some other way. The membrane-like filter 26 is extruded round by the reception housing in the embodiment shown and is consequently integrated into the same. It is alternatively possible to laminate the membrane-like filter 26 on an upper front edge of the reception housing. The membrane-like filter is preferably a PP/PTFE membrane or a TPE/PES membrane. The filter 26 serves to prevent contamination of the medium in the medium reservoir, in that the atmospheric air sucked for pressure compensation purposes through the nozzle hole D in the case of a corresponding pumping process is cleaned or purified by the corresponding membrane. Thus, the entry of water or moisture is prevented by the filter arrangement 25.

The function of the dosing device shown in FIG. 1 will now be described. The inlet valve formed by the valve plunger 10 in conjunction with the dosing lip 12 and dosing segment 13 operates in the case of a manual operation of the operating handle 20 as a slide, in that the outer pump casing part 8 together with the pump unit 9 to 11 is moved downwards. Due to the fact that in the case of a complete stroke of the pump unit the dosing lip 12 passes downwards below the dosing segment 13 and therefore below the stepped ledge in the discharge channel 6 into the open, a so-called priming is made possible. This means that the air in the pump area of the pumping device defined by the outlet chamber 17, the displacement area 14 and the annular space between the inner valve plunger 10 and the outer displacement plunger 11, during a stroke movement of the pump unit can escape downwards into the discharge channel 6 and therefore into the suction connection 7 and medium reservoir. During the following return stroke the corresponding suction of the liquid medium takes place. Due to the extremely small clearance volume within the pump area of the pumping device serving as a pump chamber preferably a single stroke is sufficient for priming purposes in order to bring about an adequate suction of the medium to be dispensed in the pump chamber. The length of the stroke of the dosing lip 12 along the dosing segment 13 defines the dosing volume. The defined dosing segment 13 stepped in tapered manner with respect to the remaining discharge channel 6 in conjunction with the valve plunger 10 running downwards into the open in slide form makes it possible, even after the end of priming, i.e. following the complete filling of the entire medium path in the discharge channel 6, as well as in the pumping or dosing chamber of the pumping device, a particularly accurate and reliable dosing.

A discharge process takes place as soon as the liquid pressure in the pump chamber, i.e. particularly in the upper area of the outlet chamber 17, which acts on the plunger-like outlet valve 16, exceeds the counter pressure applied by the compression spring arrangement. The liquid pressure forces the outlet valve 16 downwards counter to the compressive force of the compression spring arrangement, so that the corresponding medium discharge process takes place via the outlet opening 18. The outlet opening 18 is preferably nozzle-shaped in order to bring about an atomization of the dispensed medium. Obviously, prior to a corresponding discharge process, the protective cap 19 is removed.

The dosing device shown in FIG. 1 comprises a few plastic components and at present of only six plastic components. A first plastic component is constituted by the cover 1 in conjunction with the reception part 2 and the inner pump casing part 3. The second plastic component is formed by the outer pump casing part 8. The third plastic component is the pump plunger unit 9 to 11. The fourth plastic component is the plunger-like outlet valve 16. The fifth plastic component is the operating handle 20 provided with the finger rests and the final plastic component is the protective cap 19. For assembling the dosing device firstly the plunger-like outlet valve 16 together with the compression spring arrangement acting thereon is inserted in the pump plunger unit 9 and then the latter together with the outlet valve 16 is locked in the interior of the outer pump casing part 8, so that an upper face of the outlet valve 16 is pressed against the corresponding valve seat in the vicinity of the outlet opening 18. Then the outer pump casing part 8, together with the pump plunger part 9 to 11, is axially inserted into the fixed plastic component, so that locking and axial securing take place in the vicinity of the locking profiles 23, 24. The operating handle 20 is now locked axially from above on the outer pump casing part 8, so that the locking connection and axial securing between the pump casing part 8 and reception part 2 of the cover 1 is covered and secured. The filter arrangement 25 and circumferential seal are inserted in the cover 1. The cover 1 can then be tightly engaged on a corresponding medium reservoir. Prior to the axial engagement of the outer pump casing part 8 on the cover 1, the pump spring arrangement 15 is inserted.

Figure 2:
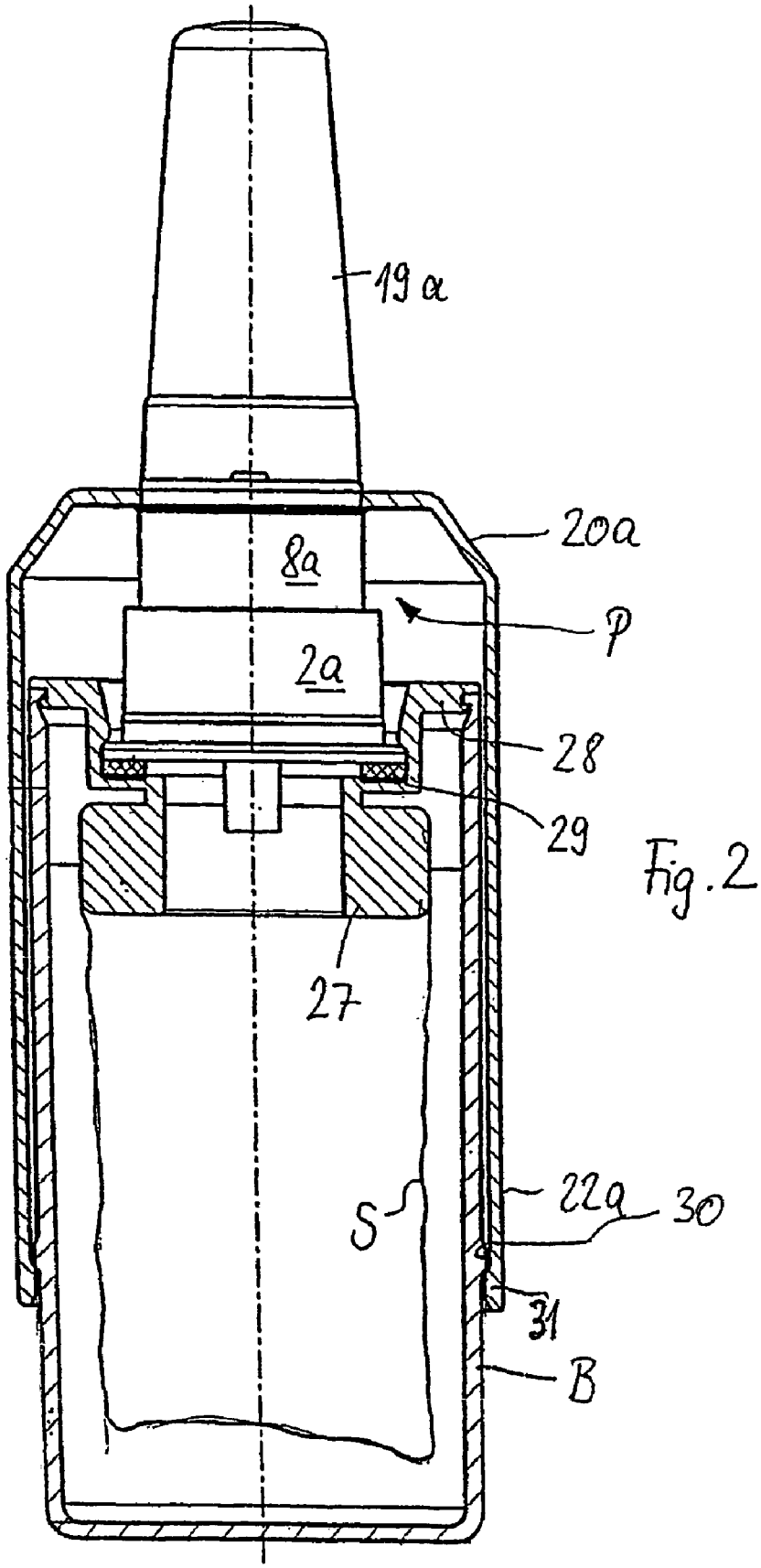
FIG. 2 Another embodiment of a dosing device with a flexible wall medium reservoir and a pumping device similar to FIG. 1.
Figure 3:
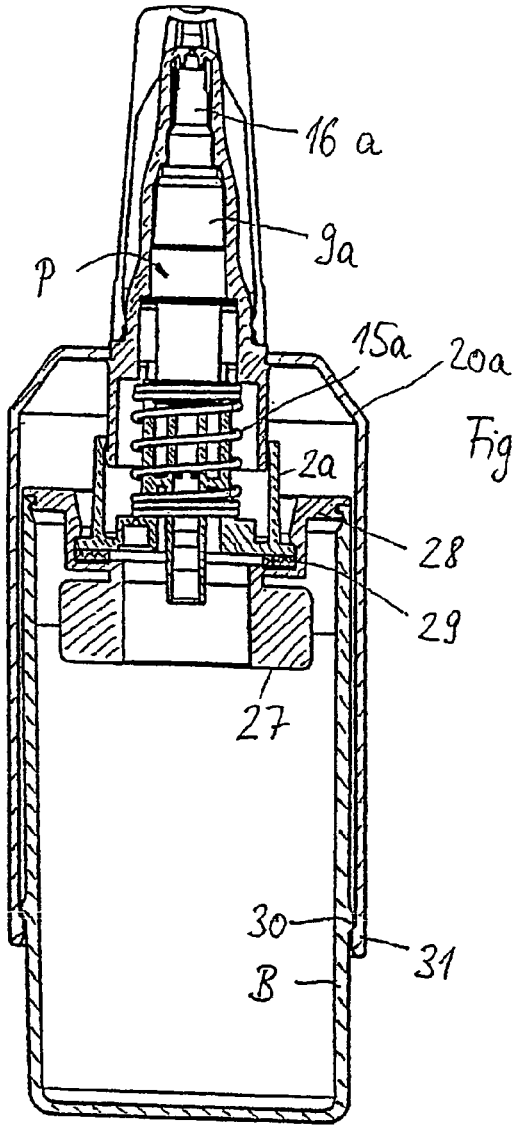
FIG. 3 The dosing device in FIG. 2 in longitudinal section.
Figure 4:
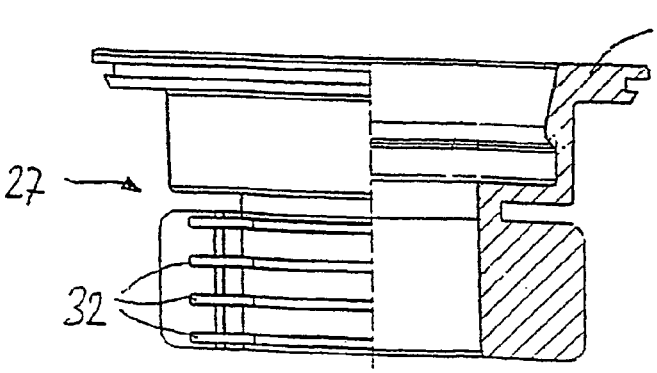
FIG. 4 A larger scale representation in half-section form of a reception unit of the dosing device according to FIG. 3 serving as a cover.

In the embodiment according to FIGS. 2 to 4 a pumping device P corresponds to the pumping device described hereinbefore relative to FIG. 1, so that for a more detailed explanation of the pumping device P reference is made to the detailed description concerning FIG. 1. Identically functioning parts are given the same reference numerals compared with FIG. 1, but followed by the letter "a". Details will now only be given of differences between the pumping device P compared with the pumping device of FIG. 1. A description will also be given of the remaining dosing device in which the pumping device P is integrated. The essential difference compared with the embodiment of FIG. 1 is that the pumping device P can be manufactured as a separate subassembly with respect to the dosing device and is detachably connected thereto. In the embodiment according to FIGS. 2 to 4 the reception part 2*a* is admittedly in one piece with the inner pump casing part. The inner pump casing part, which is surrounded by the pump spring arrangement 15*a*, together with the reception part 2*a* nevertheless constitutes a unit separate from a cover 28 for a container cup P. The cover 28 has a sleeve-like or annular design and is provided with a reception depression into which can be locked the reception part 2*a* of the pumping device P by using a circumferential annular flange. For this purpose an edge of the reception depression is provided with an annular locking point, which is clearly visible in FIGS. 2 and 3, but is not further designated. A tight, clearance-free seating of the annular flange and therefore the reception part 2*a* in the reception depression of the cover 28 is ensured by an annular seal 29, which is positioned below the annular flange and rests on a dish edge of the annular reception depression of the cover 28. The cover 28 is a plastic part and is locked or firmly connected by crimping to an upper marginal area of the container cup B.

Below the dish edge of the reception depression, the cover 28 is provided by a profile ring 27 shaped in one piece and which as an extension to the cover 28 projects into the interior of the container cup B. As can be gathered from FIG. 4, the profile ring is provided with several parallel, spaced annular ribs 32, which project radially outwards to a centre line axis of the cover 28. There are also several vertical oriented rib webs extending over the height of the profile ring 27 and which are not further designated in FIGS. 2 to 4. These rib webs are distributed over the circumference of the profile ring 27. The sectional view of FIGS. 2 and 3 is in each case traversed by two such rib webs.

With respect to its pump operating function, the operating handle 20*a* for pumping device P corresponds to the operating handle 20 of FIG. 1. The operating handle 20*a* is additionally designed as a cup-shaped cylinder jacket, which axially engages over the container cup B by more than half of its height. The outer jacket of the container cup B and an inner wall of a lower marginal area of the cylinder jacket 22 of the operating handle 20*a* are provided with corresponding stop profiles 30, 31 which positively engage behind one another in the axial direction. This gives an axial securing action for the operating handle 20*a*. As the operating handle 20*a*, like the operating handle 20 of FIG. 1, is locked on the outer pump casing part of the pumping device P, the stop profiles 30, 31 simultaneously create the stroke limitation for the pumping device P, which offers the necessary retaining force against the compressive force of the pump spring arrangement 15.

The embodiment of FIG. 2 and the representation of FIG. 3 are slightly modified. Thus, in the embodiment according to FIG. 3 the reception part 2*a* of the pumping device P contains a receptacle for the insertion of a filter arrangement, as shown in FIG. 1. Thus, if the cover 28 provides a tight seal for the container cup B, the latter can be directly used as a medium reservoir for a corresponding liquid, because despite the dimensionally stable container cup B through the receptacle provided with the nozzle hole, optionally with the additional insertion of a filter arrangement, there is an adequate pressure compensation during the operation of the pumping device P.

However, in the case of FIG. 2 there is no such pressure compensating device for the container cup B. Instead the container cup B has a medium reservoir S with flexible wall. The medium reservoir S is here in the form of a film bag produced from a one or multiple-layer film, which is circumferentially tightly connected to the profile ring 27. Preferably the film bag is welded to the profile ring 27 and the profiles of the latter enlarge the surface for a tight welding of the film bag to the profile ring 27. This ensures excellent security of the welded connection and a tight sealing of the film bag with the profile ring 27. The film bag serving as a medium reservoir S is consequently only open to the pumping device P, so that the same pumping and discharge function can be obtained as in the embodiment of FIG. 1. With each discharge process there is a reduction of the volume of the medium reservoir S, so that the film bag contracts. The flexible film bag wall consequently permits a pressure and volume compensation within the medium reservoir S during corresponding discharge processes of the pumping device P.

Figure 5:
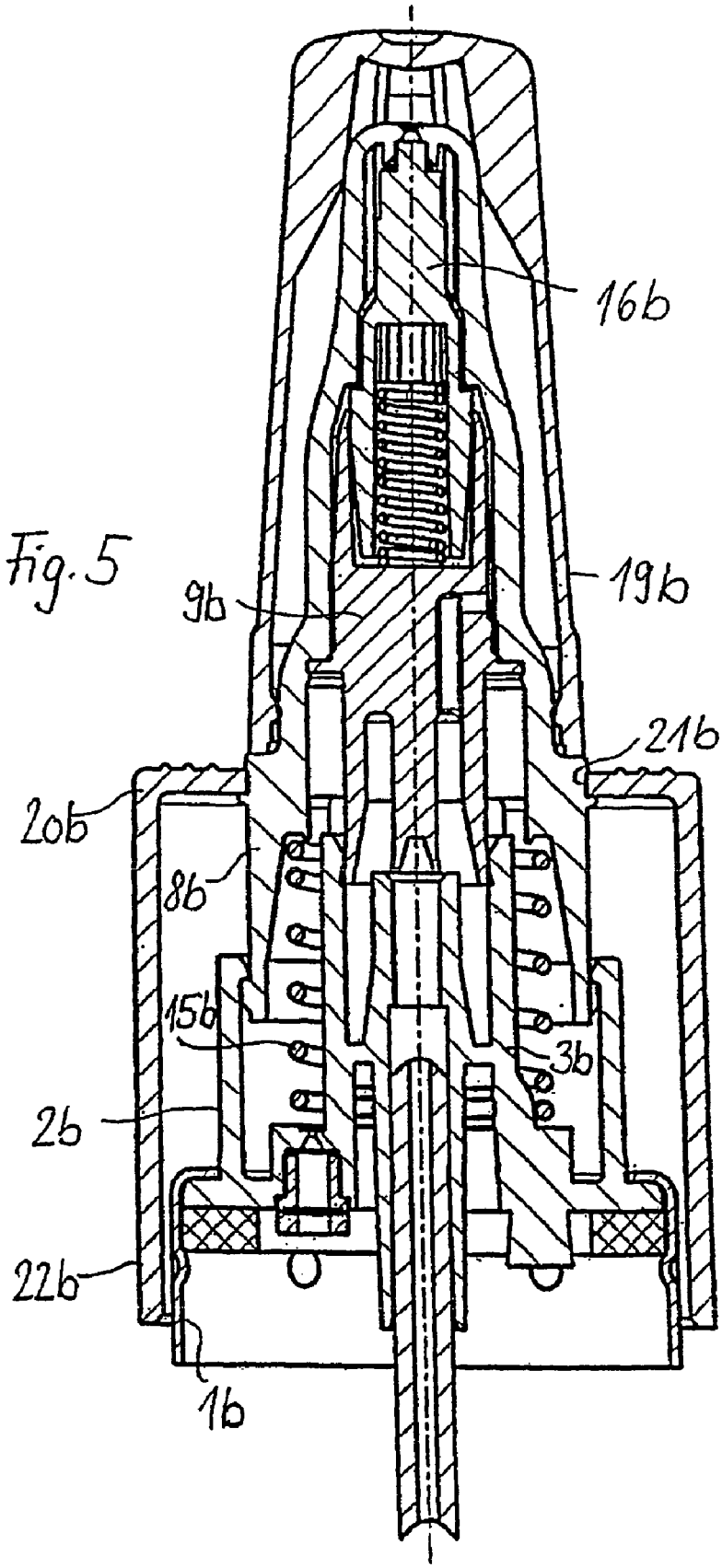
FIG. 5 A longitudinal section through a dosing device similar to FIG. 1.
Figure 6:
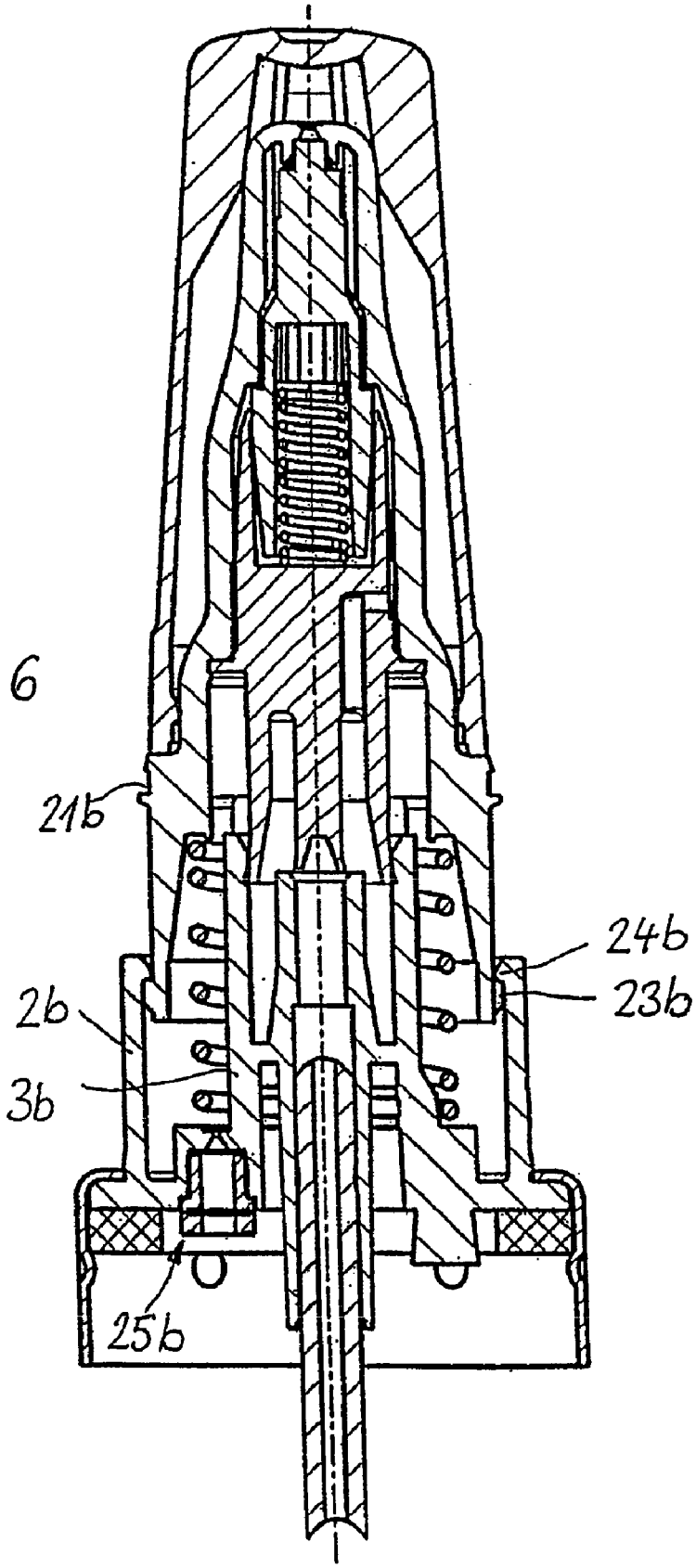
FIG. 6 The dosing device of FIG. 5 with the operating handle removed.

In the embodiment of FIGS. 5 and 6 a dosing device is shown and its pumping device corresponds to that of FIG. 1. Parts of the dosing device having the same functions are given the same reference numerals as in the embodiment of FIG. 1, but followed by the letter "b". For further details reference is made to the description concerning FIG. 1. Hereinafter reference is made solely to the differences shown in FIGS. 5 and 6. The essential difference is that the reception part 2*b*, in much the same way as in the embodiment according to FIGS. 2 to 4 is designed separately with respect to a cover 1*b*. The cover 1*b* is in the form of a crimped cover, which can be mounted on a corresponding container neck of a medium reservoir. The mounting of the reception part 2*b* together with the cover 1*b* in the form of a crimped cover takes place accompanied by the interposing of a not designated, circumferential, elastic seal. The operating handle 20*b* has a cup-shaped protective extension 22*b*, which is drawn downwards over the cover 1*b* in the form of a crimped cover, so that the protective extension 22*b* axially covers a crimped area of the cover 1*b* in the form of a crimped cover. This avoids a detachment of the cover 1*b* from a corresponding medium reservoir container neck as soon as the operating handle 20*b* has been locked on the outer pump casing part 8*b* of the pumping device in accordance with the representation and description according to FIG. 1. As the protective extension covers the crimped area of the cover 1*b*, the separately manufactured operating handle is only fitted on the pump casing part 8*b* when the cover 1*b* has been crimped onto a corresponding medium reservoir container neck, because a crimping process would not be possible when the operating handle 22*b* was already locked on.

The invention claimed is:

1. A dosing device having an outlet, comprising:

a cover element configured to mount to a medium reservoir, said cover element having an inlet passageway providing a pathway for medium from said medium reservoir, a finite length dosing chamber of uniform dimension connected in communication with said inlet passageway, said dosing chamber having at opposite ends a dimensional widening larger in dimension than said uniform dimension of said dosing chamber; and a pump casing element mounted on said cover element and configured to move with respect thereto a defined dosing stroke length along a stroke axis, said pump casing element having an outlet chamber forming a passageway communicating with said outlet of said dosing device as well as being configured to communicate with said inlet passageway, said pump casing having an elongate plunger member longer than said finite length of said dosing chamber and having on at least a portion thereof a dimension that is conformed to said uniform dimension to operatively form a sliding piston relation with said finite length dosing chamber, said dimension of said sliding piston being less than each said dimensional widening, said sliding piston being oriented on said elongate plunger member so that at opposite ends of said stroke length, said sliding piston will be oriented beyond said uniform dimension of said dosing chamber so as to form an open passageway between said medium reservoir and said outlet chamber.

2. The dosing device according to claim 1, wherein said cover element includes an annular reception space of a first volume encircling said dosing chamber, wherein said pump casing element includes an annular displacement body encircling said elongate plunger and has a second volume approximately equal to said first volume, said annular displacement body being configured to enter said annular reception space at a beginning of said dosing stroke and to occupy approximately all of said annular reception space when said sliding piston is at an end of said dosing stroke.

3. The dosing device according to claim 2, wherein said inlet passageway, said dosing chamber and said annular displacement body of said cover element are integrally formed from the same material.

4. The dosing device according to claim 1, wherein a pump spring is provided between said cover element and said pump casing element to facilitate a return of said pump casing element to a beginning position relative to said cover element.

5. The dosing device according to claim 1, wherein said cover element includes an annular reception space of a first volume encircling said dosing chamber, wherein said pump casing element includes an annular displacement body encircling said elongate plunger and has a second volume approximately equal to said first volume, said annular displacement body being configured to enter said annular reception space at a beginning of said dosing stroke and to occupy approximately all of said annular reception space when said sliding piston is at an end of said dosing stroke, and wherein said cover element further includes a first annular space encircling said annular reception space and said pump casing element includes a second annular space encircling said annular displacement body, said first and second annular spaces being coaxial and housing therein said pump spring.

6. The dosing device according to claim 5, wherein said pump spring is oriented remotely from said passageway between said medium reservoir and said outlet chamber.

7. The dosing device according to claim 1, wherein said pump casing element includes a valve body oriented between said outlet chamber and said outlet of said dosing device and configured to move relative to said cover element between a first position closing the passageway between said outlet chamber and said outlet of said dosing device and a second open position, a return spring for continually urging said valve body to said second closed position.

8. The dosing device according to claim 7, wherein said pump casing element includes a valve chamber open at one end and closed at the other end and in which said valve body is reciprocally provided, said return spring being provided between said valve body and said closed end of said valve chamber for continually urging said valve body toward and into engagement with a valve seat provided adjacent said open end of said valve chamber.

9. The dosing device according to claim 7, wherein said return spring is oriented remotely from said passageway between said medium reservoir and said outlet of said dosing device.

10. The dosing device according to claim 2, wherein said outlet chamber is configured to communicate with inlet passageway through said dosing chamber during intervals that said sliding piston is oriented at said opposite ends of said stroke length.

11. The dosing device according to claim 10, wherein said annular displacement body sealingly slidingly engages a wall of said annular reception space so that as said annular displacement body is moved out of said annular reception space, a vacuum will be created in a region vacated by said annular displacement body such that when the sliding piston becomes oriented at said beginning of said dosing stroke, said vacuum will draw medium from said dosing chamber into said annular reception space.

12. The dosing device according to claim 11, wherein said annular displacement body and said annular reception space are additionally configured to urge medium out of said annular reception space in response to a movement of said annular displacement body into said annular reception space and a simultaneous movement of said sliding piston through said dosing chamber, said conformance of said dimensions of said sliding piston and said dosing chamber preventing the flow of medium therebetween.

* * * * *